US010876811B2

(12) United States Patent
Abbatescianni et al.

(10) Patent No.: US 10,876,811 B2
(45) Date of Patent: Dec. 29, 2020

(54) FENCING WEAPON WITH KIT AND METHOD TO ILLUMINATE THE SAME

(71) Applicants: Girolamo Abbatescianni, Milan (IT); Renzo Armelin, Voghera (IT)

(72) Inventors: Girolamo Abbatescianni, Milan (IT); Renzo Armelin, Voghera (IT)

(73) Assignees: Girolamo Abbatescianni, Milan (IT); Renzo Armelin, Voghera (IT)

( * ) Notice: Subject to any disclaimer, the term of this patent is extended or adjusted under 35 U.S.C. 154(b) by 169 days.

(21) Appl. No.: 16/302,493

(22) PCT Filed: May 23, 2017

(86) PCT No.: PCT/IB2017/053024
§ 371 (c)(1),
(2) Date: Nov. 16, 2018

(87) PCT Pub. No.: WO2017/212360
PCT Pub. Date: Dec. 14, 2017

(65) Prior Publication Data

US 2019/0293384 A1 Sep. 26, 2019

(30) Foreign Application Priority Data

Jun. 6, 2016 (IT) ..... 102016000057784

(51) Int. Cl.
*F41B 13/02* (2006.01)
*A63B 71/06* (2006.01)
*A63B 69/02* (2006.01)

(52) U.S. Cl.
CPC ..... *F41B 13/02* (2013.01); *A63B 69/02* (2013.01); *A63B 71/0622* (2013.01); *A63B 2225/74* (2020.08)

(58) Field of Classification Search
CPC ... F41B 13/02; A63B 69/02; A63B 2069/025; A63B 2207/02; A63B 2207/00; A63H 33/009
See application file for complete search history.

(56) References Cited

U.S. PATENT DOCUMENTS 4,904,222 A * 2/1990 Gastgeb ..... A63H 5/00 310/331
6,360,615 B1 * 3/2002 Smela ..... A61B 5/1124 73/862.474
6,575,837 B1 * 6/2003 Weske ..... A63B 69/02 463/47.1
6,669,601 B2 * 12/2003 Marciano ..... A63B 71/10 482/12
2004/0162003 A1 8/2004 Vanaver
(Continued)

FOREIGN PATENT DOCUMENTS

CN 103801063 5/2014
WO 2015077553 5/2015

*Primary Examiner* — Reginald A Renwick
(74) *Attorney, Agent, or Firm* — Pearne & Gordon LLP

(57) ABSTRACT

Lighting kit (1) for weapons in use in fencing comprising: a light source (6); at least one guided propagation member (10) of light (L) generated by the source (6), said member (10) being disposed within a groove (11) formed on a blade (9) of said weapon for use in fencing; constraint means (16) for firmly engaging the propagation member (10) within said groove (11); and supply means (18) electrically connected to the light source (6).

13 Claims, 2 Drawing Sheets

(56) References Cited

U.S. PATENT DOCUMENTS

| | | | | |
|---|---|---|---|---|
| 2009/0149256 | A1* | 6/2009 | Lui | A63F 13/245 463/37 |
| 2010/0100997 | A1* | 4/2010 | Lee | H01R 13/2407 2/69 |
| 2011/0159939 | A1* | 6/2011 | Lin | A63B 69/32 463/8 |
| 2015/0148140 | A1 | 5/2015 | Morehouse et al. | |
| 2016/0193515 | A1* | 7/2016 | Kline | A63B 69/00 434/255 |

* cited by examiner 7
8
1
10
3
2
9
15
15b
14
13
17
IV
IV
4
5
16
11
12

FENCING WEAPON WITH KIT AND METHOD TO ILLUMINATE THE SAME

The present invention relates to a lighting kit and method for weapons in use in fencing, and a weapon for sport use.

In particular, the present invention relates to a lighting kit and lighting method thereof for weapons in use in fencing, namely foil, sword and saber.

The present invention also relates to a weapon, in particular a sword or other cold weapons of various types, used in a sports context such as fencing.

As is well known, the weapons in use in fencing comprise foil, sword and saber. All weapons are made up of a handle, which can be of different shape depending on the weapon and the sport specialty, and of a blade with a downward slant from the handle to the respective tip.

The bell-guard, i.e. the sword-guard extends between the handle and the blade and also has a different shape depending on the type of weapon and is capable of protecting the hand of the athlete.

In the particular case of the foil, the blade has a cross-section substantially rectangular in shape.

In the case of the sword and saber, the cross-section of the blade is substantially flat and has a "V"-shaped profile. In the particular case of the saber, the cross sectional profile is not constant as it has a "V"-shape in the part near to the bell-guard, while in the part near to the tip it has a substantially flat "I"-shape.

Also, while the saber blade is more rigid, the blade is more flexible in foils and swords. Another common feature for foils and swords is the presence of the switch placed on the blade tip that is closed, allowing a current passage whenever the weapon strikes the target. Indeed, in these two specialties, the score is assigned only to the tip thrust, while in the case of the saber the score is assigned if the weapon strikes with any portion of the blade.

For this reason, both the foil and the sword have a longitudinal groove on the upper surface of the blade for housing an electrical cable connecting said switch placed on the blade tip to an electrical connector placed inside the bell-guard and coupled to the handle.

In the saber, instead, the blade is electrified as well as the jacket that is worn by the athlete, so that it closes the circuit when it comes into contact with the opponent's jacket.

In all cases, the electrical connector is then connected to a signal transmission system designed arranged to detect, by means of light (and acoustic) members arranged in the competition area, the assignment of the score.

Generally, on the platform (the area where the competition is held) light bulbs of different colours are disposed, which are activated whenever the score is assigned. The transmission system is therefore responsible for transferring the signal from the connector, through a cable engaged to the athlete's jacket, which extends towards an end area of the platform. The cable is held at a low voltage by a winding system that allows to retrieve excess cable length when the athlete moves back towards the respective end of the platform.

The weapons for use in the fencing described above, however, have important disadvantages.

These disadvantages are mainly related to the ability to display blades which, during the "assault" phase, are moved at high speeds by athletes. As a result, the movement of weapons is difficult to see, resulting in complexity in understanding the action.

This disadvantage appears to be limiting for the public following the assault, but it is even more important for the athletes themselves and for the match administrator.

In fact, as far as athletes are concerned, the sudden movement of the blade, which is flexible and therefore in continuous vibration, results in a considerable difficulty in perceiving the opponent's movement. In addition, it should be noted that athletes are wearing safety masks made of metal mesh, which, on the one hand, have the advantage of protecting the face of the fencer, however, on the other, constitute an obstacle in the overall view.

In addition, the match administrator also finds difficulty in the clear action of the weapon. In this context, it should be noted that, according to the sports rules in the specialties of the foil and the saber, in the case of contemporary thrust, the administrator must reconstruct the action to assign the score. It is therefore necessary to analyse in detail and in a clear and unambiguous way the blade path during the combat action.

The object of the present invention is therefore to provide a kit and a lighting method thereof for weapons in use in fencing that are capable of solving the above-mentioned problems.

In particular, an object of the present invention is to provide a lighting kit for weapons in use in fencing that is able to make the blade more visible during the normal practice.

In addition, an object of the present invention is to provide a lighting kit that can be used for any weapon in use in fencing, namely foil, sword and saber, without having to change the structure of the weapon itself.

Furthermore, an object of the present invention is to provide a lighting method for weapons in use in fencing that is able to clearly indicate the movement of the blade to the public, and to the athletes and the match administrator as well.

It is a further object of the present invention to provide a lighting kit and lighting method that are simple both structurally and in the application stage, having in addition low construction costs.

Finally, a further object of the present invention is to provide a weapon for sport use, preferably a cold weapon such as a sword or the like, which is easily visible.

The technical task mentioned and the objects stated are substantially achieved by a lighting kit and method for weapons in use in fencing, and by a weapon for sport use, comprising the technical characteristics set out in one or more of the appended claims.

Further characteristics and advantages of the present invention will become more apparent from the description of a exemplary, but not exclusive, and therefore non-limiting preferred embodiment of a lighting kit and a weapon for sport use, as illustrated in the appended figures, in which.

Figures 3, 4, 4A, 5:
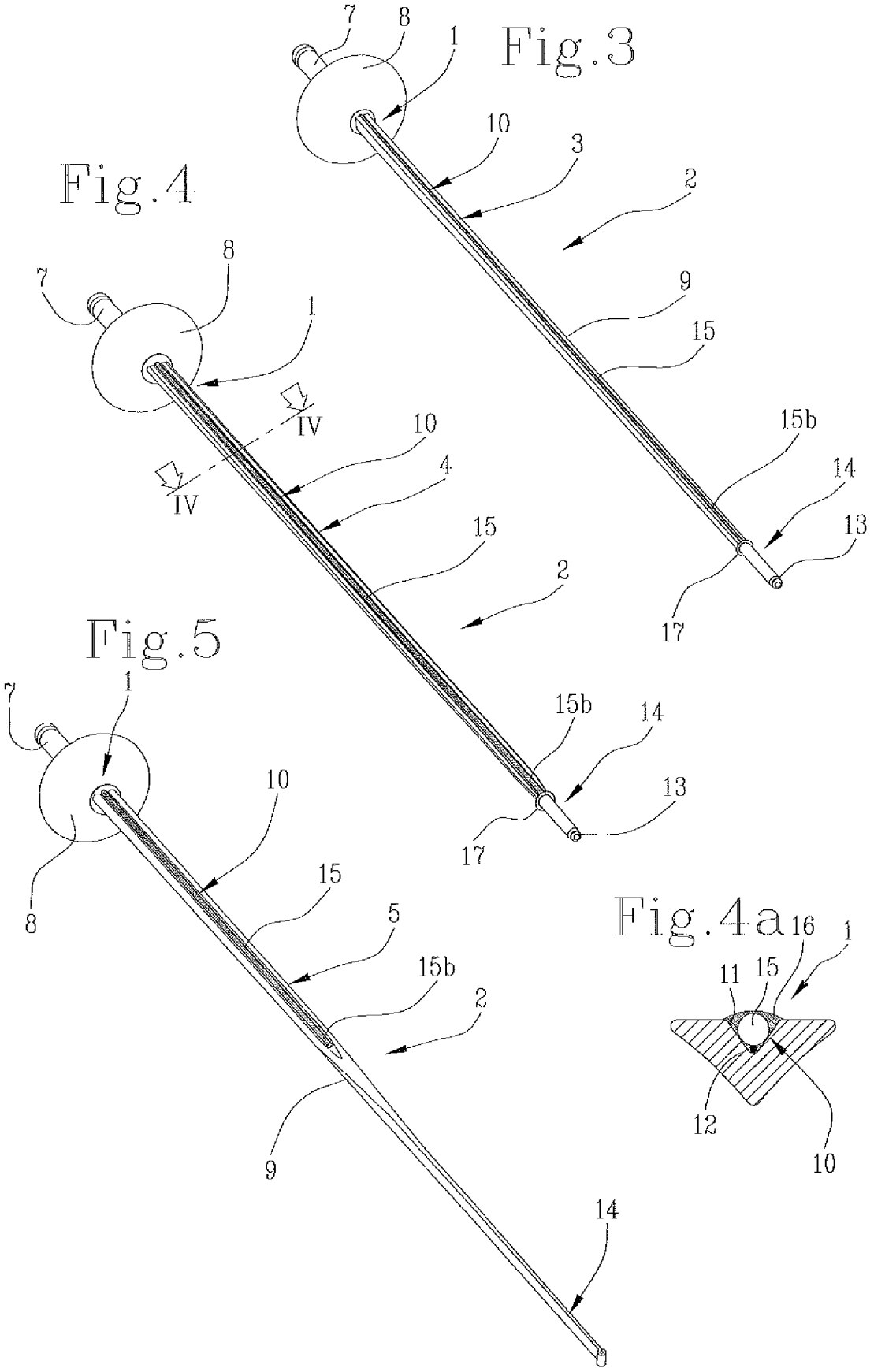
FIG. 3 shows a perspective view of a foil in use in fencing, provided with the lighting kit according to the present invention.
FIG. 4 shows a perspective view of a sword in use in fencing, provided with the lighting kit according to the present invention.

FIG. 4*a* shows a cross-sectional view along the line IV-IV of the sword of FIG. 4 provided with the lighting kit according to the present invention; and FIG. 5 shows a perspective view of a saber in use in fencing, provided with the lighting kit according to the present invention.

With reference to the accompanying figures, a lighting kit for weapons 2 in use in fencing is generally indicated with the reference number 1.

It should be noted that the present invention is applicable for weapons 2 in use in fencing, namely foil 3 (FIG. 3), sword 4 (FIG. 4) or saber 5 (FIG. 5).

Advantageously, the present invention finds advantageous application in the particular case of the sword 4 in use in fencing.

Figure 2:
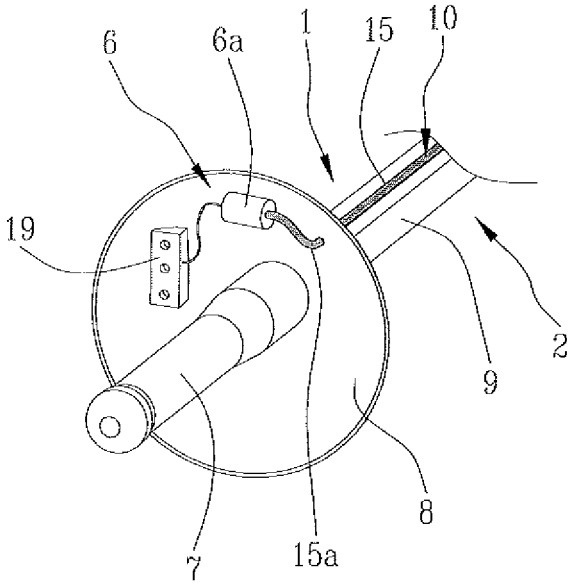
FIG. 2 shows a perspective view of a construction detail of FIG. 1.

In greater detail, the kit 1 comprises a light source 6, preferably consisting of at least one LED 6*a*, which can be positioned at a handle 7 of the weapon 2 (FIG. 2).

The LED 6*a*, illustrated only schematically in FIG. 2 as of the known type, is adapted to generate a light "L" having electromagnetic frequency within the visible spectrum. This electromagnetic frequency is predetermined according to the various requirements in order to generate a light of a specific colour. In this way, during use, the weapons 2 of the two fencers "U" will have a light of different colour (for example a red and a blue) to be better identified.

Preferably, always referring to FIG. 2, the source 6 is arranged at an inner area of the bell-guard 8 of the weapon 2, which divides said handle 7 with the blade 9 of the sword.

However, it must be specified that the source 6 can be arranged in any area outside the blade, or associated with the jacket "G" of the user "U".

The kit 1 also includes at least one guided propagation member 10 of light "L" generated by the source 6.

Such member 10 is advantageously disposed within a groove 11 formed on blade 9 of the weapon 2.

It should be noted that the foil 3 and the sword 4 and the saber 5 have a groove 11 that extends on a blade 9 surface. In particular, the groove 11 of the foil 3 and the sword 4 extends along the entire longitudinal extension of the blade 9, whereas for the saber 5 the groove 11 extends only to a portion of the blade 9 adjacent to the bell-guard 8.

Inside the groove 11 of the foil 3 and the sword 4, an electric cable 12 (visible in the section of FIG. 4*a*) extends, connecting with a switch 13 disposed on the tip 14 of the blade 9. As previously specified, such switch 13 enables indicating when the target is reached with the tip 14 of the weapon 2.

Note that in the view of FIG. 4*a* the blade 9 of the sword 4 has a "V" conformation in cross-section, in which said groove 11 is defined.

The guided propagation member 10 of light "L" comprises at least one optical fibre 15 extending along the longitudinal extension of the groove 11 formed on the blade 9.

The optical fibre 15 has a first end 15*a* connected to the light source 6 and a second end 15*b* opposed to the first 15*a* and close to the tip 14 of the blade 9.

In this situation, the optical fibre 15, in the preferred case of the sword 4 or the foil 3, extends along the entire longitudinal extension of the blade 9. In the case of the saber 5, the fibre optic 15 extends only partially with respect to the blade 9.

Advantageously, the fibre optic 15 has a length of 550 mm in the saber and of 880 mm in the sword, plus 150 mm within the bell-guard, and a thickness ranging from 1 to 3 mm in cross-section.

Still, fibre optic 15 is preferably of the type capable of propagating light along the entire respective longitudinal surface.

The kit 1 also includes constraint means 16 for firmly engaging the propagation member 10 within the groove 11.

The constraint means 16, better illustrated in FIG. 4*a*, comprise at least one resin or glue, transparent to light radiation to propagate the light "L" propagated by the fibre 15. Preferably, the constraint means 16 is made of EVA (Ethylene Vinyl Acetate), or reactive polyurethane-based glue.

The constraint means (resin or glue) is also distributed along the entire groove 11 so as both the fibre 15 and the electric cable 12 are embedded within it. In this way, the fibre 15 remains firmly engaged within the groove 11.

The constraint means (resin or glue) 16 further defines an annular portion 17 arranged about the second end 15*b* of the optical fibre 15 to diffuse the light along an annular path and concentric to the axis of longitudinal extension of the blade 9. Advantageously, the light "L" diffused at the tip 14 of the blade 9 is more visible because it is diffused on all sides of the blade 9.

Figure 1:
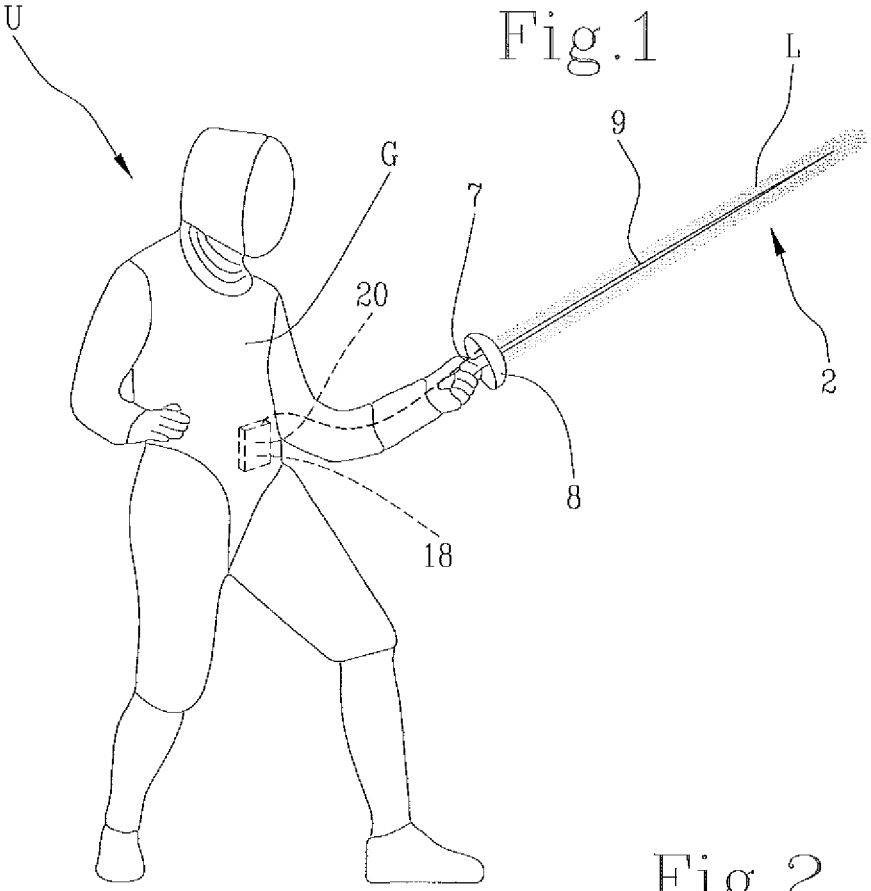
FIG. 1 shows a side and schematic view of a weapon for sport use, and in particular of a fencing sword provided with the lighting kit according to the present invention and in a condition of use.

The light source 6 is also connected to supply means 18 electrically connected to the LED 6*a* by means of suitable cables of a known type. Preferably, the supply means 18 (FIG. 1) comprise an electric battery that can be associated with the uniform (jacket or trouser) "G" of the user "U". In this case, the electrical connection is implemented through a connector 19 located inside the bell-guard 8 (FIG. 2) and provided for the electrical connection of the signal transmission cable 12. It should be noted in FIG. 2 that the source 6 is suitably connected to said connector 19.

In addition, the kit 1 is provided with a processing logic unit 20 to activate and deactivate the light source by means of a manual switch (not shown in the attached figures) and according to a given electrical signal.

In other words, by means of the logic unit, the user "U" can enable or disable the source 6 to illuminate his or her weapon 2.

In addition, the logic unit manages the lighting according to a predefined software for managing the source 6. In this way, in accordance with a first possibility of operation, the light "L" is always switched on during the assault, even after the thrust.

In addition, the logic unit 20 can automatically turn off the light "L" at each thrust by the weapon 2. In this case, the unit 20 is suitably connected to the thrust assignment system that is activated by the switch 13 or the electric contact with the blade 9 of the saber 5.

Alternatively, an automatic switching on can only be provided after the thrust. In this case, the light "L" is not generated during the assault.

The present invention further relates to a lighting method for weapons 2 in use in fencing, comprising the steps of: providing the light source 6; housing at least one guided propagation member 10 of light "L" generated by the source 6 within the groove 11 formed on blade 9 of the weapon 2. Subsequently, the propagation member 10 is firmly constrained within the groove and the light source is electrically powered for generating a light radiation that propagates through said member 10.

The step of providing the light source is implemented by positioning at least one LED at the handle 7 of the weapon 2.

In this way, the LED generates the light "L" according to a predetermined electromagnetic frequency within the spectrum visible and corresponding to a respective colour.

The step of housing the propagation member 10 is implemented by providing at least one optical fibre 15 along the longitudinal extension of the groove 11. A first end 15*a* of the fibre 15 is then connected to the light source 6.

Advantageously, the light "L" generated by the LED is then passed along the fibre 15 and propagated through it to the outside.

Therefore, the light "L" diffuses from the entire outer surface of the fibre 15 and throughout its longitudinal extension.

The step of constraining the propagation member 10 within the groove 11 is implemented by distributing a liquid-phase resin or adhesive 16 on the optical fibre 15 and within the groove 11.

Subsequently, the resin-glue 16 is hardened and solidified to anchor the optical fibre 15 and the cable 12 within the groove 11. The resin-glue 16 is transparent to light radiation to facilitate the passage of light "L" towards the outside of the groove 11.

In addition, the resin-glue 16 realizes an annular portion 17 arranged about the second end 15*b* of the optical fibre 15 to diffuse the light along an annular path and concentric to the axis of longitudinal extension of the blade 9.

The source 6 is then activated and deactivated by means of a manual switch and according to a given operating logic.

In particular, the logic unit 20 manages the supply of the source 6 to keep the light "L" always switched on, or always switched on and switched off only after the thrust, or always turned off and activated after the thrust.

The present invention solves the problems of the prior art and has many advantages.

First, the kit 1 illuminates the blade 9 by making the weapon 2 more visible during the assault phases.

Even at high speed, typical the weapon handling by high-level athletes, the blade 9 can be clearly visualized by appreciating its movement.

This increased visibility thanks to the light "L" has advantages for the public as well as for the assault, and for the match administrator and individual athletes as well.

In fact, the match administrator can clearly visualize the movement of weapons by capturing more accurately and immediately the thrust movements in order to assign the score.

Even for individual athletes, the light "L" emitted by the blades 9 allows for greater visibility of the opponent's movement by exceeding the visibility limits provided by the masks.

In addition, the kit 1 is applicable to any weapon 2 in use in fencing, namely foil 2, sword 4 and saber 5, without having to change the structure of the weapon 2.

In fact, all the kit 1 components can be applied to previously determined zones of the weapon 2 such as the groove 11 formed on the blade 9 or the inner zone of the bell-guard 8. In this regard, it should be noted that such components do not interfere with the structure of the weapon 2, and therefore do not imply any change in the use of the weapon.

Finally, a further advantage of the present invention is due to the structural simplicity of the kit 1, which is made up of easily findable components, whose costs are therefore particularly low.

The lighting method can also be implemented in a simple and fast way, and therefore at very low cost, on weapons in use in fencing.

The invention claimed is:

1. Lighting kit for weapons in use in fencing, comprising:

a light source (6);

at least one light (L) guided propagation member (10), the light being generated by said source (6), said member (6) being housed inside a groove (11) formed on a blade (9) of said weapon (2) used in fencing;

constraint means (16) for stably engaging the propagation member (10) within said groove (11); and supply means (18) electrically connected to said light source (6);

characterized in that said light source (6) comprises at least one LED (6*a*) which can be positioned at a handle (7) of the weapon; said LED (6*a*) generating a light (L) having electromagnetic frequency within the visible spectrum; said light guided propagation member (10) comprising at least one optical fibre (15) extending along the longitudinal extension of the groove (11) formed on the blade (9); said optical fibre (15) having a first end (15*a*) connected to the light source (6) and a second end (15*b*) opposite to the first end (15*a*) and close to the tip (14) of the blade (9), and said constraint means (16) comprising at least one resin or glue, transparent to light radiation to propagate the light (L) propagated by the fibre (15); said resin-glue being distributed along the entire groove (11).

2. Kit according to claim 1, characterized in that said optical fibre (15) extends along the entire longitudinal extension of the blade (9); said weapon (2) being a foil (3) or a sword (4).

3. Kit according to claim 2, characterized in that said optical fibre (15) has a length between 550mm and 880mm, and in that said optical fibre (15) has a size of between 1mm and 3mm in cross-section.

4. Kit according to claim 3, characterized in that said optical fibre (15) propagates the light (L) along the respective longitudinal surface.

5. Kit according to claim 1, characterized in that said resin-glue (16) further comprises an annular portion (17) arranged about the second end (15*b*) of the optical fibre (15) to diffuse the light (L) along an annular path and concentric to the axis of longitudinal extension of the blade (9).

6. Kit according to claim 1, characterized in that it further comprises a processing logic unit (20) to activate and deactivate the light source (6) by means of a manual switch and according to a given electrical signal.

7. Kit according to claim 1, characterized in that said supply means (18) comprise a battery associable to a user's (U) garment.

8. Lighting method for weapons in use in fencing, comprising the steps of:

providing a light source (6);

housing at least one light (L) guided propagation member (10), the light being generated by said source (6) inside a groove (11) formed on a blade (9) of said weapon (2) in use in fencing;

firmly constraining the propagation member (10) within said groove (11); and electrically powering said light source (6) for generating a light radiation that propagates through said member (10);

characterized in that said step of predisposing the light source (6) is implemented by positioning at least one LED (6*a*) at a handle (7) of the weapon (2); said LED (6*a*) generating a light (L) having a predetermined electromagnetic frequency within the visible spectrum; said step of housing the propagation member (10) is implemented by providing at least one optical fibre (15) along the longitudinal extension of the groove (11) formed on the blade (9); and connecting the optical fibre (15) at a first end (15*a*) to the light source (6) and said step of propagating the light radiation is effected by diffusing the radiation along the entire longitudinal surface of the optical fibre (15).

9. Method according to claim 8, characterized in that said step of constraining the propagation member (10) in the groove (11) comprises the substeps of:

distributing a liquid resin or adhesive (16) on the optical fibre (15) and within said groove (11);

and then hardening the resin-glue to make it solid; said resin-glue being transparent to light radiations.

10. Method according to claim 9, characterized in that said step of distributing the resin-glue (16) further comprises the substep of making an annular portion (17) arranged about the second end (15*b*) of the optical fibre (15) to diffuse the light (L) along an annular path and concentric to the axis of longitudinal extension of the blade (9).

11. Method according to claim 8, characterized in that it further comprises the steps of activating and deactivating the light source (6) by means of a manual switch and according to a given electrical signal.

12. Sport weapon including:

a handle (7);

a blade (9) extending from said handle (7);

a guard (8) interposed between the blade (9) and the handle (7);

characterized in that it comprises a lighting kit (1) for a weapon in use in fencing, comprising:

a light source (6);

at least one light (L) guided propagation member (10), the light being generated by said source (6), said member (10) being housed inside a groove (11) formed on the blade (9) of said weapon (2) used in fencing;

constraint means (16) for stably engaging the propagation member (10) within said groove (11); and supply means (18) electrically connected to said light source (6);

characterized in that said light source (6) comprises at least one LED (6*a*) which is positioned at the handle (7) of the weapon; said LED (6a) generating a light (L) having electromagnetic frequency within the visible spectrum; said light guided propagation member (10) comprising at least one optical fibre (15) extending along the longitudinal extension of the groove (11) formed on the blade (9); said optical fibre (15) having a first end (15*a*) connected to the light source (6) and a second end (15*b*) opposite to the first end (15*a*) and close to the tip (14) of the blade (9), and said constraint means (16) comprising at least one resin or glue, transparent to light radiation to propagate the light (L) propagated by the fibre (15); said resin-glue being distributed along the entire groove (11).

13. Sport weapon according to claim 12, characterized in that it is constituted by a sport sword (2) with the blade (9) having a cross section "V"-shaped profile, and defining the longitudinal groove (11) extending along the extension of the blade (9) itself.

* * * * *